United States Patent [19]

Ramsower

[11] Patent Number: 5,058,667

[45] Date of Patent: Oct. 22, 1991

[54] RECIPROCATING WATER WELL PUMP

[76] Inventor: Vernon O. Ramsower, 1402 Ebeling Dr., Plainview, Tex. 79072

[21] Appl. No.: 616,172

[22] Filed: Nov. 20, 1990

[51] Int. Cl.[5] ..... E21B 43/00

[52] U.S. Cl. ..... 166/68; 166/105

[58] Field of Search ..... 166/68, 68.5, 105, 108

[56] References Cited

U.S. PATENT DOCUMENTS 2,946,387 7/1960 Hooker, Jr. ..... 166/105

4,880,062 11/1989 Bland et al. ..... 166/105 X

*Primary Examiner*—William P. Neuder

*Attorney, Agent, or Firm*—Wendell Coffee

[57] ABSTRACT

A reciprocating pump for pumping water uses a displacement plunger which operates with a seal in the middle of a cylinder within which it reciprocates. A portion of the water flows from above the plunger and a portion of the water flows from below the plunger through an annulus between the cylinder and a housing. The valves are all rings concentric with the axis of the plunger, cylinder, and housing.

5 Claims, 2 Drawing Sheets

RECIPROCATING WATER WELL PUMP

RIGHTS TO INVENTIONS UNDER FEDERAL RESEARCH

There was no federally sponsored research and development concerning this invention.

BACKGROUND OF THE INVENTION (1) Field of the Invention

This invention relates to pumping liquids from wells and more particularly to a reciprocal pump for water wells.

(2) Description of the Related Art

Much of the water used in the United States for domestic, municipal and agricultural use is produced from deep wells. Many of these wells are over 100' deep. The cost of pumping water from them is considerable. Practically all pumps presently in use are rotary pumps and generally centrifugal type pumps. This invention is a high capacity double acting pump. By high capacity is meant, one that will pump more than 50 gallons per minute.

SUMMARY OF THE INVENTION (1) Progressive Contribution to the Art

This application discloses a double acting pump which is adapted for a particularly long stroke. Also it is adapted to be significantly trouble free.

To achieve the significantly trouble free status the pump is designed to operate without any springs in the pumping mechanism. Also the pump is designed to be a reciprocating pump. The pump will normally be a displacement pump so that there are only two or three seals within the pump. One is the seal in the middle of the cylinder within which a plunger reciprocates. A second seal is where the sucker rod or sucker shaft enters the pump.

In certain cases it may be desirable to increase the weight for the return or downward stroke of the pump, in which case a weight would be hung below the plunger and therefore a seal below the plunger would be used. To obtain maximum capacity through a small diameter well bore, it is desirable to have the diameter of the pump to be as small as possible. Therefore this necessitates a particularly long stroke for which reason a walking beam type pump jack is used which has been found well adapted for use in oil field practice. Also, the valve are all arranged to be concentric valves. I.e., the valve openings and valve seats are arranged in a ring shape around the axis of the pump. In this way a maximum amount of water flow can be obtained without increasing the diameter of the pump and also without undue restrictions of the flow of the water through the valves.

The valves are all arranged so that the valve seats are on the top of the plates through which water passages are located. The valves proper are in the form of washers, or disks with a co-axial hole therethrough, or in the form of a flat ring or donut. All of the valves are closed by the water pressure and gravity; eliminating the need for springs. The valves are also substantially trouble free, and inexpensive in manufacture.

Pump efficiency, because of the long stroke and positive action, is high. Good efficiency results in a saving of power to operate the pump which in turn results in a conservation of energy.

The conservation of energy and particularly petrochemical used to create the power for the pump, is a major consideration in the design of the pump.

This also prohibits the burning of fuels to produce either electrical power or direct mechanical power thereby preventing emissions into the atmosphere. Therefore this pump is designed to be ecologically beneficial.

(2) Objects of this Invention

An object is to pump water from wells.

Further objects are to achieve the above with devices that are sturdy, trouble free, compact, durable, lightweight, simple, safe, efficient, versatile, ecologically compatible, energy conserving, and reliable, yet inexpensive and easy to manufacture, maintain, and repair.

The specific nature of the invention, as well as other objects, uses, and advantages thereof, will clearly appear from the following description and from the accompanying drawings, the different views of which are not necessarily scale drawings.

Figure 1:
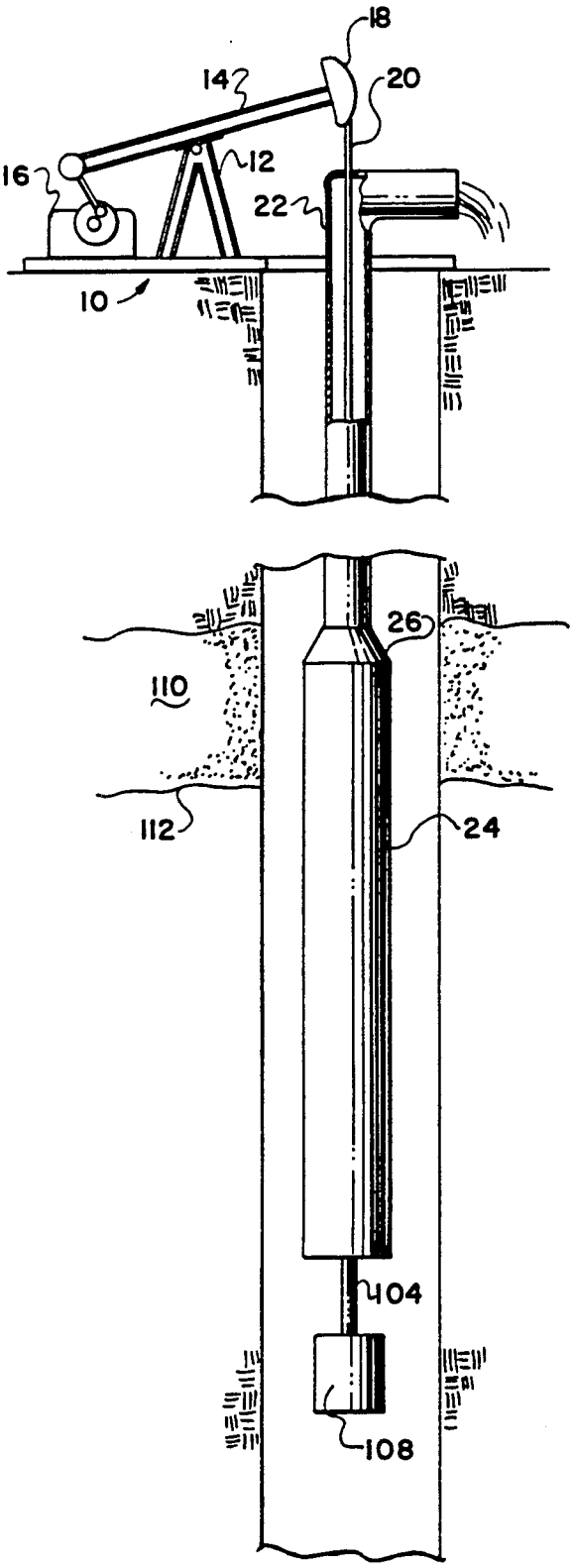
FIG. 1 is a sectional view, schematic in nature, of a pump according to this invention in a well.

As an aid to correlating the terms of the claims to the exemplary drawing(s), the following catalog of elements is provided:

10 pump jack
12 sampson post
14 walking beam
16 crank and pitman
18 horse head
20 sucker shaft
22 eduction pipe
24 housing
26 connection
28 cylinder
30 annulus
32 bottom valve assembly
34 bottom inlet valve plate
36 bottom outlet valve plate
38 bottom tube
39 adapters
40 outer portion pipe
42 bottom valve annulus
44 openings
46 passageways
48 washer valve
50 valve guides
52 passageways
54 washer valve
56 top valve assembly
58 adapter
60 outer pipe
62 top outlet plate
64 seal
66 passageways
68 washer valve
70 top plate
72 passageways 74 spool
76 top inlet tube
78 spool bottom
80 top inlet tube
82 passageways
84 washer valve
86 top inlet annulus
88 passageways
90 tubes
92 top valve annulus
94 plunger
96 plunger seal
98 upper pipe
100 lower pipe
102 cuff
104 bottom shaft
106 bottom seal
108 weight
110 formation
112 bottom of formation
120 upper portion
122 lower portion
124 inlet ring
132 passageway
160 upper valve assembly pipe
188 inlet passageways

DESCRIPTION OF THE PREFERRED EMBODIMENTS(S)

According to the drawings there may be seen schematically represented a pump jack 10 including sampson post 12, walking beam 14, crank and pittman assembly 16, and horsehead 18. The above ground equipment provides means for reciprocating the sucker rod or shaft 20.

Eduction pipe 22 is hung at the surface of the ground and extends downward to housing 24 of the pump deep below the ground. The housing 24 is connected to the eduction pipe 22 by connection 26 at the top of the housing.

The housing 24 is an upright cylindrical housing, for example, made from metal pipe 12" in outside diameter.

Cylinder 28 is telescoped within the housing 24 coaxially therewith. Between the cylinder 28 and housing 24 will exist a passageway which is herein designated as cylinder annulus 30. Water pumped on the down stroke from the bottom portion of the pump will flow upward through this annulus 30. Bottom valve assembly 32 will include such major parts as bottom inlet valve plate 34, bottom outlet valve plate 36, and bottom tube 38.

Bottom tube 38 is connected to the bottom of the cylinder 28 by adapters 39. These adapters are fluid tight so that there is no loss of the water from the cylinder 28 except as it is pumped in and out through the bottom tube 38. The bottom outlet valve plate 36 is securely attached and water proof or leak proof, to the bottom tube 38.

The bottom tube 38 is shown in its preferable form as extending to the bottom inlet valve plate 34 and attached thereto. Strictly speaking, this extension of the bottom tube 38 below the bottom outlet valve plate 36 is not necessary since the outlet valve plate 36 is attached to the inlet valve plate 38 by outer pipe-like portion 40 of the bottom valve assembly 32.

With the bottom tube 38 so extended, a bottom valve annulus 42 is formed between the bottom tube 38 and the pipe 40. Openings 44 in the tube below the outlet valve plate 36 permit the flow of water between the annulus 42 and the interior of the tube 38.

Figure 2:
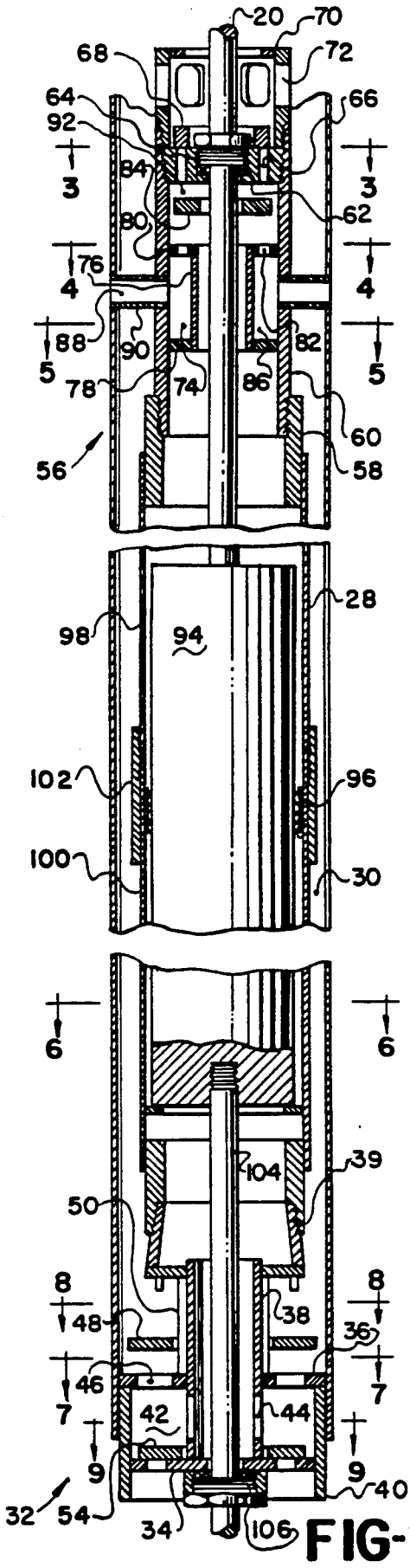
FIG. 2 is an axis sectional view of the pump.
Figure 3:
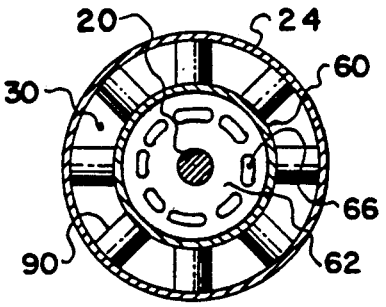
FIGS. 3 through 9 are cross-sectional views taken on FIG. 2 substantially as indicated.
Figure 7:
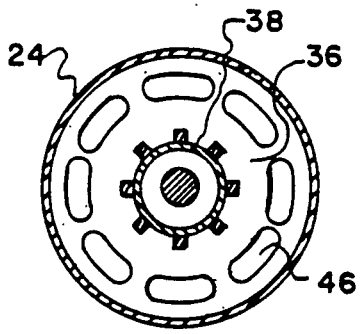
Figure 4:
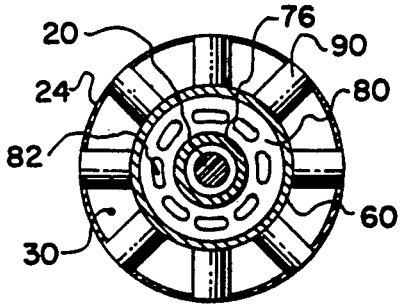
Figure 8:
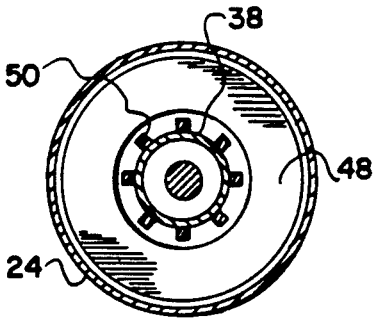
Figure 5:
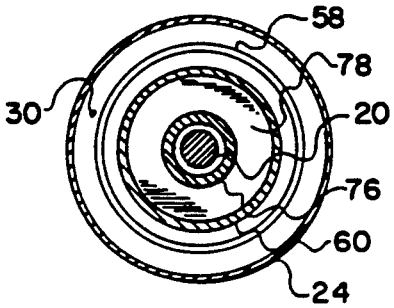

The bottom outlet plate 36 has a plurality of openings or passageways 46 therethrough. The top of these passageways form a valve seat. Washer valve 48 is shown in FIG. 2 as above a seated position upon that valve seat. It may be seen (FIGS. 7 & 8) that there are eight valve guides 50 attached around the outside of the bottom tube 38 to cause the washer valve 48 to correctly seat upon the valve seat at the top of bottom outlet plate 36.

Figure 9:
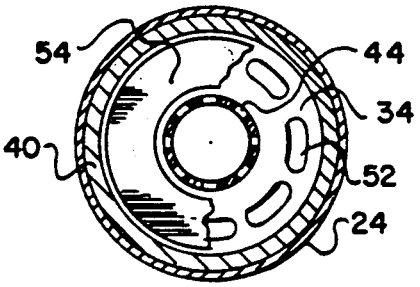
Figure 6:
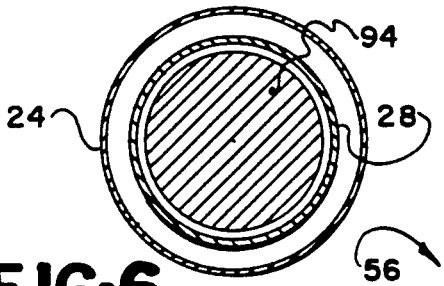

Likewise the bottom inlet plate 34 has a plurality of passages 52 to permit water to enter from the well into the valve annulus 42. However, it cannot escape from the valve annulus 42 because the valve 54 is shown resting upon the valve seat on the top of the inlet plate 34. Washer valve 54 is shown broken away in FIG. 9 for purposes of illustration.

Top valve assembly 56 is attached to the top of cylinder 28 by adapter 58. It is likewise fluid tight so that water passes only from within cylinder 28 into the valve assembly and particularly within its outer pipe 60. At the top or near the top of the top valve assembly and its pipe 60 top outlet plate 62 is attached. The top outlet plate 62 has a concentric opening with seal 64 for sucker shaft 20 to reciprocate without loss of fluid therethrough. The top outlet plate 62 also has a plurality of passageways 66 which terminate on the upper side of plate 62 with valve seats. Washer valve 68 is shown seated upon this valve plate to close it.

The top of the top valve assembly could be open, however, it is preferable to partially close the top with a plate 70 and provide for fluid passageways 72 from the top of the top valve assembly 56. On the inside of the mid portion of the top valve assembly pipe 60 is located spool 74 which includes top inlet tube 76 with spool bottom 78 at the bottom of the tube 76. Top inlet plate 80 is at the top of the spool which is to say at the top of the inlet tube 76. It also has passageways 82 therethrough. These passageways have a valve seat at the top of the plate 80 and are closed by washer valve 84. Top inlet annulus 86 is formed between the plate 78, 80 and the tube 76 and pipe 60. Water is received into the inlet annulus through the inlet passageways 88 through the tubes 90. The tubes 90 connect the pipe 60 and thus the top valve assembly 56 to the housing 24. In addition to forming a passageway, they also form a structural connection between the housing 24 and the cylinder 28.

Also it may be seen, that a top valve annulus 92 is formed between the pipe 60, the shaft 20, and the inlet valve plate 80 and the outlet valve plate 62.

The lower end of the sucker shaft 20 is connected to the plunger 94. As illustrated, the plunger is a solid cylinder of metal. It has clearance between its outside diameter and the inside diameter of cylinder 28. For example, the outside diameter of the plunger 94 might be 8" while the inside diameter of the cylinder was 8½" so that there would be a ¼" of clearance around the plunger 94. This would provide for a wall thickness of the cylinder of ¼". Plunger seal 96 is located at about the mid point of the cylinder 28. Preferably the cylinder 28 is formed of two pipes, an upper pipe 98 and a lower pipe 100 connected by the cuff 102. As an example, the plunger 94 could be slightly less than 10' in length and have about a 10' stroke so that each of the cylinder pipes 98 and 100 would be slightly longer than 10'. The seal 96 is connected to the cuff 102 and provides a fluid tight seal between the cylinder 28 and the reciprocating plunger 94.

In some instances the solid metal plunger 96 will not provide enough weight for the proper downward movement of the plunger 94. It will be understood that if the housing 24 is for example, over 100' below the surface of the earth, that the downward push of the sucker shaft 20 for this length is not a completely satisfactory method of causing the plunger 94 to move downward. It is more desirable that the plunger 94 or weight 108 on the bottom of the plunger 94 would be sufficient to move it downward. To provide additional weight, if desirable, bottom shaft 104 is attached to the bottom of the plunger 94. This bottom shaft 104 extends through fluid seal 106 co-axially located in the bottom inlet valve plate 34. As seen in FIG. 1 then, additional weight 108 is attached to the bottom of the shaft 104.

It will be understood that for proper operation the water level must be above the passageways 88 located near the top of the housing 24. Therefore if the top of the housing 24 was located near bottom 112 of water bearing formation 110 it would be necessary for the well to extend on 30' or 40' below the bottom 112 of the water bearing formation so there would be ample room for the reciprocation of the weight 108.

The operation of the invention is described at this point.

Upon the downstroke, water within the cylinder 28 below the plunger 94 will be forced downward through the bottom tube 38 and the passages 44 into the bottom valve annulus 42. From there it flows through the passageways in the outlet valve plate 36 forcing the washer valve 48 upward. From there it flows upward through the cylinder annulus 30 on through the top connection 26 and out the eduction pipe 22. Also during the downward stroke the reduced pressure in the top of the cylinder 28 will cause the water at higher pressure outside of the housing 24 to flow through the passageways 88 up through the tube annulus 86 and the passageways in the top inlet valve plate 80 pushing the washer valve 84 upward so that it flows downward through the tube 76 into the top of the cylinder charging the top of the cylinder for the upward stroke.

At the upward stroke the upward movement of the plunger 94 causes the water to flow upward by closing the washer valve 84 and causing the water to flow through the annulus 92 upward through the passageways 66 in the top outlet plate 62 pushing the washer valve 68 upward so that the water flows upward into the connection 26 and out the eduction pipe 22.

As this is taking place there will be reduced pressure below the plunger 94 causing a reduction of pressure within the bottom valve annulus 42 which will permit by gravity and water pressure above to close the valve 48. Also the reduced pressure in the bottom valve annulus 42 will cause the pressure below the housing 24 to raise the washer valves 54 and water to flow inward through the passageways through the bottom inlet plate 34 and in through the passageways 44 to inside the bottom tube 38 and thus charging the bottom portion of this cylinder 24 to the expelled by the next downward stroke as explained above.

Figure 10:
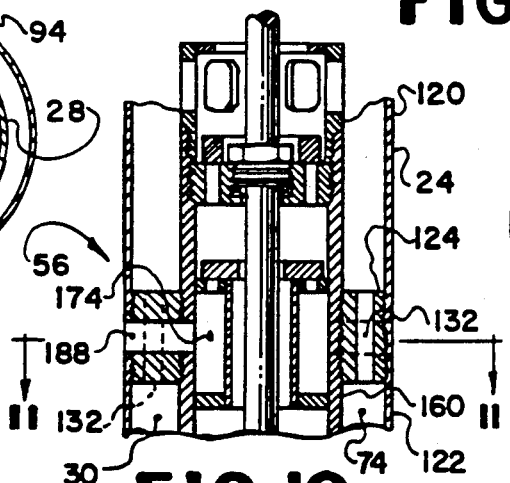
FIG. 10 is an axial sectional view similar to FIG. 2 of that part, of the pump of a modified form of the top inlet.
Figure 11:
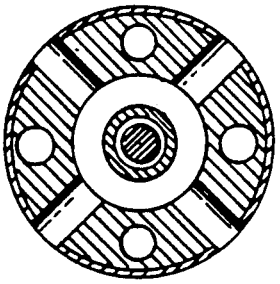
FIG. 11 is a cross-sectional view taken on line 11—11 of FIG. 10.

The embodiment described above is the preferred embodiment. However, a modification may be seen in FIG. 10. In that figure the housing 24 has an upper portion 120 and a lower portion 122. A thick inlet ring 124 connects these two portions together by exterior threads on the outer periphery of the cylindrical inlet ring 124. Likewise the upper valve assembly pipe 160 is in two parts and threaded to screw into a circular opening in ring 124. Then the inlet passageways 188 would be through radial holes bored through the thick inlet ring 124.

In this way it may be seen that the ring 124 would both provide inlet passageways 188 into the inlet annulus 174 and also provide structural support in relationship between the top of the cylinder 28 and the housing 24.

It will be understood that in addition to the radial holes 188 forming a passageway for the inlet water there would be axial passageways 132. In operation water flows upward through cylinder annulus 30 through the axial passageways 132 on upward to the connection 26.

This description has been made for use of persons with ordinary skill in the art. Certain details of construction such as the means by which certain pieces are attached together by wells or the connection of the sucker shaft 20 to the horsehead 18, nor the seal above the surface of the ground around the sucker shaft 20 have not been illustrated, inasmuch, as it is believed those having ordinary skill in the art would understand the construction of these details.

The embodiment shown and described above is only exemplary. I do not claim to have invented all the parts, elements or steps described. Various modifications can be made in the construction, material, arrangement, and operation, and still be within the scope of my invention.

The limits of the invention and the bounds of the patent protection are measured by and defined in the following claims.

I claim as my invention:

1. A pump comprising:

an upright cylindrical housing, a connection on top of the housing for connecting the housing to an eduction pipe, a cylinder having a top and bottom telescoped within the housing, a cylindrical annulus between the cylinder and the housing, a bottom valve assembly having a top thereof connected to the housing below the cylinder, a bottom tube connected to the bottom of the cylinder coaxial therewith, said tube connected to the top of said bottom valve assembly, a bottom inlet valve plate on said bottom valve assembly, inlets through said bottom inlet valve plate terminating with bottom inlet valve seats on the top of the bottom inlet valve plate, a washer valve seated upon all of said bottom inlet valve seats, a top outlet valve plate on the top of said bottom valve assembly, outlet opening through said top plate terminating in bottom outlet valve seats on the top of the top outlet valve plate, a washer valve seated upon all of the bottom outlet valve seats, a bottom valve annulus within the bottom valve assembly between the bottom plate and the top plate, a top valve assembly attached to said housing above the cylinder, a top tube connected to the top valve assembly and the top of the cylinder, a top inlet valve plate, inlets through said top inlet valve plate, terminating with top inlet valve seats on the top of the plate, a washer valve seated upon all of said top inlet valve seats, a top outlet valve plate connected to said top valve assembly above said top inlet valve plate, a top valve annulus between the top inlet valve plate and the top outlet valve plate, openings through said top outlet valve plates, terminating in top outlet valve seats on the top thereof, a washer valve seated upon the top outlet valve seats, an inlet valve annulus below the top inlet valve plate, inlet passageways from outside the housing into the top inlet valve annulus, a plunger having a top and bottom telescoped within said cylinder, a seal between the plunger and the cylinder connected to said cylinder about half way between the top and bottom of said cylinder, a sucker shaft attached to the top of the plunger and a sucker rod seal on the top outlet valve plate between the sucker shaft and said top outlet valve plate.

2. The invention as defined in claim 1 wherein said inlet passageways from outside the housing are in the form of inlet tubes connected to the housing with openings through the housing, and said inlet tubes connected at an opposite end to the top valve assembly and opening into said inlet annulus.

3. The invention as defined in claim 1 wherein said inlet passageways from outside the housing are through a top inlet ring having a top and bottom, said housing having a main portion and a top portion, said top portion connected to the top of said inlet ring, said main portion connected to the bottom of said inlet ring, said cylinder having a top portion and a main portion, said top cylinder portion connected to the top of said inlet ring, and said main cylinder portion connected to the bottom of said inlet ring.

4. The invention as defined in claim 1 further comprising:

a pump jack on top of the ground, an eduction pipe extending from above the top of the ground to the connection on top of the housing, and said sucker shaft extending from said pump jack through said eduction pipe.

5. The invention as defined in claim 1 further comprising:

a bottom shaft attached to the bottom of the plunger, a bottom rod seal on the bottom inlet valve plate between the bottom shaft and the bottom inlet valve plate, and a weight on the bottom of the bottom shaft.

* * * * *